United States Patent [19]

Hartman

[11] 3,975,695

[45] Aug. 17, 1976

[54] WAVEGUIDE BEYOND CUTOFF COUPLER FOR COUPLING TO RESONANT CAVITY

[75] Inventor: Richard L. Hartman, Huntsville, Ala.

[73] Assignee: The United States of America as represented by the Secretary of the Army, Washington, D.C.

[22] Filed: June 10, 1975

[21] Appl. No.: 585,913

[52] U.S. Cl. ..... 333/24 R; 333/81 B; 333/98 R; 333/99 S

[51] Int. Cl.[2] ..... H01P 5/04

[58] Field of Search ..... 333/24 R, 83 R, 98 R, 333/99 S, 81 B

[56] References Cited

UNITED STATES PATENTS

| | | | |
|---|---|---|---|
| 2,675,524 | 4/1954 | Collard | 333/98 R |
| 3,518,580 | 6/1970 | Hartman | 333/98 R X |

*Primary Examiner*—Paul L. Gensler
*Attorney, Agent, or Firm*—Nathan Edelberg; Robert P. Gibson; Charles R. Carter

[57] ABSTRACT

A coupler capable of correctly coupling a microwave source into a resonant cavity in a cryogenic environment. The coupler utilizes a rotary mechanical means to adjust the energy through the waveguide-beyond-cutoff into the cavity and control the reflections thereby.

3 Claims, 2 Drawing Figures

WAVEGUIDE BEYOND CUTOFF COUPLER FOR COUPLING TO RESONANT CAVITY

DEDICATORY CLAUSE

The invention described herein may be manufactured, used, and licensed by or for the Government for governmental purposes without the payment to me of any royalties thereon.

BACKGROUND OF THE INVENTION

This invention relates to the field of waveguide beyond cutoff couplers. Several difficulties have been experienced with the use of known waveguide beyond cutoff couplers in a cryogenic environment. These difficulties include fragile components, complex machine work for mechanical guidance of the control structure, such as slotting the waveguide on the side, inserting teflon screws and control with a rod outside the apparatus, difficulty in sealing the connection of the control to the cavity structure from cryogenic fluids and coupler rod shrinkage when operating in cryogenic fluids.

SUMMARY OF THE INVENTION

The present invention has provided a solution to the above stated problems by using a rotary mechanical means to adjust the tuning slug and locating this coupler movement control in the microwave flow path. This arrangement results in a simplier construction and the differential expansion of the control rod versus the waveguide does not change the location of the tuning slug.

This invention may be better understood from the following detailed description taken in conjunction with the accompanying drawing.

DESCRIPTION OF THE PREFERRED EMBODIMENT

Figures 1, 2:
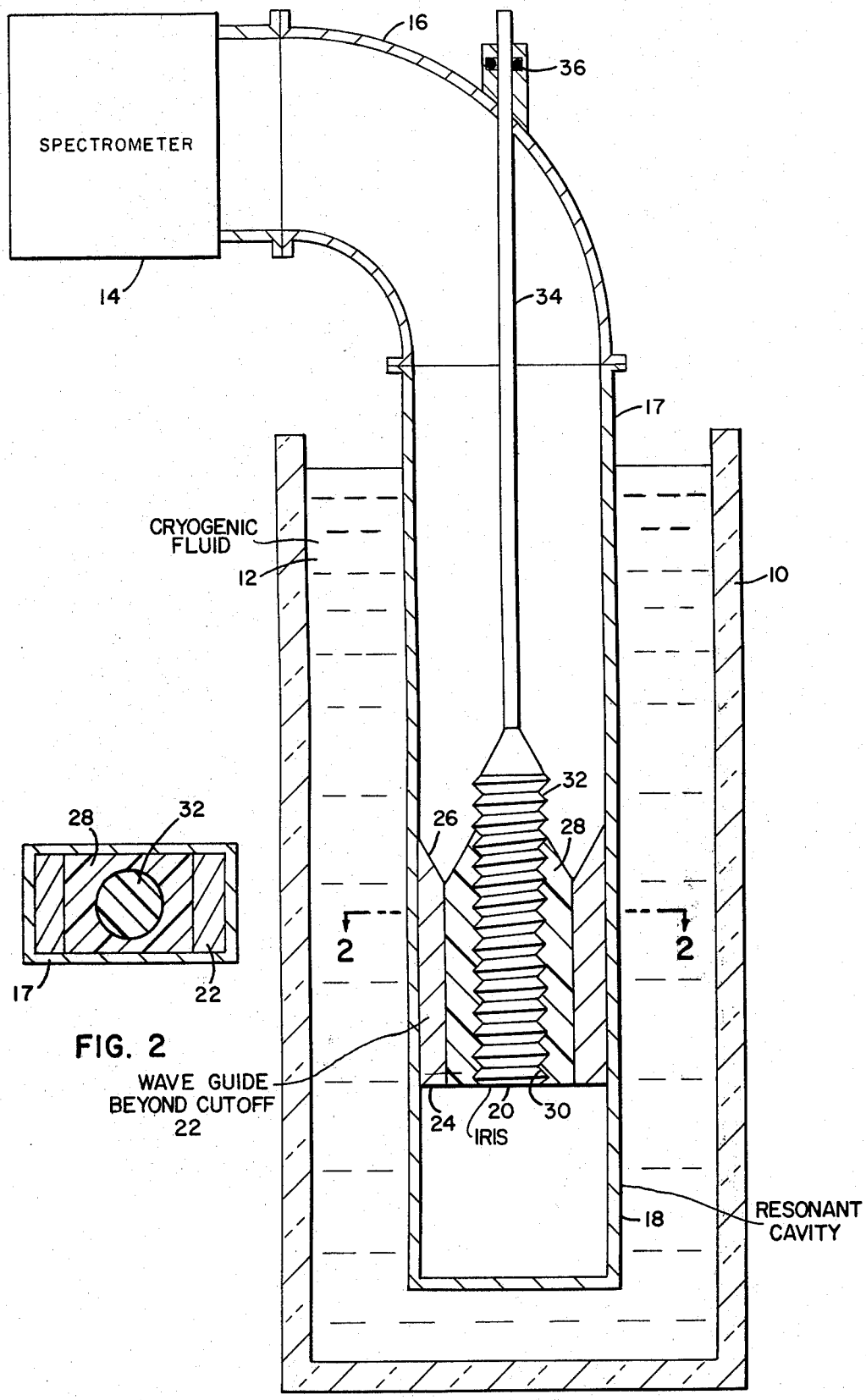
FIG. 1 is a sectional view of the coupler mechanism.
FIG. 2 is a sectional view along line 2—2 of FIG. 1.

Referring now to the drawing, reference numeral 10 represents a glass receiver which contains a cryogenic fluid of liquid helium and a vacuum 12. A microwave source such as a spectrometer 14 is connected to a microwave elbow 16 and waveguide section 17 usually rectangular. The waveguide section 17 is connected to a resonant cavity 18, made of brass, which allows the microwaves to enter but not to exit. The resonant cavity is attached to the microwave system through a coupling iris 20, which is a fixed opening having a size that is predetermined prior to the assembly of the coupler. A waveguide beyond cutoff hollow cylindrical section 22, also rectangular and made of brass, extends from the iris plane 24 to a tapered top 26 which reduces unwanted microwave reflections. Closely fitted within section 22 is a smaller hollow rectangular body 28 of Teflon that is provided with a cylindrical opening internally threaded at 30. A Teflon tuning slug 32 is externally threaded for rotary connection with the body 28 and controlled by rod 34. The rod exits outside the microwave system through an O ring seal 36 in the elbow 16. Both body 28 and slug 32 are made of the same material which eliminates differential thermal contraction from making the screw thread too tight or too loose.

In operation, the object in coupling to a resonant cavity is to have the energy from the microwave system enter the cavity and especially to control the reflections therein. This is achieved by adjusting the portion of the incident energy which enters the cavity against the portion leaving the cavity. The coupling iris 20 is made large enough so that too much energy could enter into the cavity 18 but the waveguide beyond cutoff section 22, with body 28 inserted, cannot pass microwaves well, so too little energy enters the cavity. When the tuning slug 32 is screwed into the body 28, the dielectric constant of the material (typically Teflon) raises the cutoff frequency, allowing microwaves to pass. Thus the amount of microwave energy passed through section 22 is adjusted by the extent to which the slug 32 is inserted into body 28 and therefore the energy entering the cavity is controlled.

I claim:

1. A waveguide beyond cutoff coupler for connecting a microwave source into a resonant cavity said coupler comprising: a waveguide section adapted to be connected between said microwave source and said resonant cavity; a hollow brass section provided with an outwardly tapered top disposed within said waveguide section; a hollow dielectric body disposed within said section, said body having threads on its internal wall; a tuning slug disposed inside of said body and having external threads thereon for a rotary connection with said body and a rod connected to said tuning slug for controlling the rotary movement of said slug and thereby the amount of source energy coupling to said resonant cavity.

2. A waveguide beyond cutoff coupler as set forth in claim 1 wherein said body and said tuning slug are made of Teflon.

3. A microwave source to resonant cavity cutoff coupling mechanism comprising; a waveguide elbow connected to said microwave source and to a waveguide section; a resonant cavity at one end of said waveguide section; a coupling iris for connecting said waveguide section to said cavity; a hollow brass section provided with an outwardly tapered top; a hollow Teflon body disposed within said hollow brass section, said body having threads on its internal wall; a Teflon tuning slug disposed inside of said body and having external threads thereon for rotary connection with said body; said hollow section, body and tuning slug being disposed within said waveguide section to control said coupling iris and a rod connected to said tuning slug for controlling the rotary movement of said slug, said rod extending through said elbow for external control.

* * * * *